United States Patent [19]

Hollingsworth

[11] Patent Number: 4,865,211

[45] Date of Patent: Sep. 12, 1989

[54] COLLAPSIBLE ARTICLE

[76] Inventor: Elmont E. Hollingsworth, 12100 Wander La., Austin, Tex. 78750

[21] Appl. No.: 164,341

[22] Filed: Mar. 4, 1988

[51] Int. Cl.[4] ..... B65D 1/02; B65D 25/44; B65D 37/00

[52] U.S. Cl. ..... 220/8; 138/119; 215/1 C; 222/95; 222/107; 222/215; 222/527

[58] Field of Search ..... 215/1 C; 150/55; 222/95, 107, 215, 527; 138/119; 220/8

[56] References Cited

U.S. PATENT DOCUMENTS

| | | | |
|---|---|---|---|
| 2,723,779 | 11/1955 | Parker et al. | 222/104 |
| 2,880,902 | 4/1959 | Owsen | 220/8 |
| 2,899,110 | 8/1959 | Parker | 222/215 |
| 3,559,847 | 2/1971 | Goodrich | 222/107 |
| 3,587,937 | 6/1971 | Childs | 222/213 |
| 3,626,939 | 12/1971 | Maltenfort et al. | 222/107 X |
| 4,044,836 | 8/1977 | Martin et al. | 169/30 |
| 4,256,154 | 3/1981 | Black | 222/527 X |
| 4,456,134 | 6/1984 | Cooper | 215/1 C X |
| 4,492,313 | 1/1985 | Touzani | 215/1 C |
| 4,717,525 | 1/1988 | Iizuka et al. | 264/521 |

FOREIGN PATENT DOCUMENTS

| | | | |
|---|---|---|---|
| 1413545 | 2/1965 | France | 215/1 C |
| 781103 | 8/1957 | United Kingdom | 222/95 |

*Primary Examiner*—Sue A. Weaver
*Attorney, Agent, or Firm*—David L. Mossman

[57] ABSTRACT

A tubular article, such as a plastic bottle, of optionally stepped cross-sections, with one section next to one of the steps incorporating near vertical tucks permits collapsing of the article. Under an axial force, the bottle or article will collapse in a telescoping manner by inverting inside for outside of the section with the tucks. The invention of the tucks stretch or expand them which increases the area enclosed by the cross-section and thereby allows the telescoping in a pre-determined manner. Reversing the axial force will cause the collapsed container to extend or expand.

13 Claims, 2 Drawing Sheets

COLLAPSIBLE ARTICLE

FIELD OF THE INVENTION

The invention relates to collapsible articles and containers, and more particularly relates to collapsible plastic containers that telescope to a smaller size occupying less volume.

BACKGROUND OF THE INVENTION

Bags that easily collapse under a small exterior force into a shape determined by the applied force because they are constructed of flexible material for most of their surface have many short-comings. Various bellows designs in present use for collapsible bottles provide containers that collapse, but tend to spring back or expand to resume their original shape. Latching mechanisms or over-center features to overcome this phenomenon have been used to provide a container that changes its shape and size from one useful configuration to the other.

Containers that collapse in a telescoping manner that depend on the draft of the sides to ease the collapsing stress are severely limited in geometries that are functional. Additionally, these containers are usually capable of other than axial collapsing or telescoping, which may be undesirable. For example, see U.S. Pat. No. 2,880,902 which teaches a collapsible article, such as a drinking cup, of the bellows type. The device has a generally conical body made from a relatively flexible material such as polyethylene. The body has a plurality of annular stepped sections of successively decreasing diameter, alternate ones of which have relatively thick walls while the other ones have relatively thin walls.

Of interest is U.S. Pat. No. 2,723,779 which describes a tubular plastic container having thin sidewalls with spiral ridges around the outside of the wall. The spiral ridges aided the collapse of the walls onto the axis of the container thereby dispensing viscous materials, such as cake frosting. While such a container reduces its volume as it is emptied, since it collapses along its axis, its axial length or height remains approximately the same. Additionally, it appears unlikely that this container would retain its contracted shape without an applied outside force thereon.

In an improvement to the container of U.S. Pat. No. 2,723,779, U.S. Pat. No. 2,899,110 to the same inventor describes two bellows-type collapsible containers. One has a plurality of straight, parallel pleats normal or transverse to the axis of the container, while the other has a plurality of spiral pleats, similar to the '799 design. These versions not only collapse in volume, but also in their axial direction. However, each of these containers are of complex design and are not readily adaptable to conventional container configurations. They also appear to be limited to circular cross-sections.

Collapsible containers employing conventional bellows designs are well known. U.S. Pat. No. 3,587,937 discloses a collapsing dispenser of the bellows type having a spout that projects outward and retracts with the contents of the container. U.S. Pat. No. 4,044,836 describes an axial compression powder dispenser of the bellows type, in particular for dispensing fire extinguishing powders. Finally, U.S. Pat. No. 4,492,313 teaches a foldable plastic bottle of circular bellows-like configuration. The bellows are formed to over center as the bottle is collapsed thus preventing the bottle from returning to its full height before or after the cap is placed upon the bottle. The bellows have conical sections comprising alternating short portions and long portions, the short portions being at greater angle to the bottle axis than the long portions.

While a latching feature such as that described in the '313 patent may be desirable in some applications, other applications may utilize a configuration that can be collapsed and expanded many times. The bottle type of the '313 patent only collapses to more than half of its original size, and thus may not collapse to the extent desired or required by some applications.

SUMMARY OF THE INVENTION

Accordingly, it is an object of the present invention to provide an article, such as a bottle, that will collapse in a telescoping manner through predetermined and stable configurations from the as-molded size and shape to a smaller, defined size and shape. This method of collapsing saves height as well as volume.

It is another object of the present invention to provide a container that can be changed from one useful shape to another and then returned to the previous shape without damage to the container.

It is yet another object of the invention to provide an article, such as a bottle or container, with a collapsing function having a minimum of complexity in the mold required to form the bottle, or in the complexity and/or the cost of the bottle as molded and used in its largest useful size.

Still another object of the present invention is to provide a collapsible article that may be provided in cross-sectional geometries other than circular, and which will collapse only in a predetermined direction.

In carrying out these and other objects of the invention, which will become more apparent as this description proceeds, there is provided, in one form, a collapsible article that collapses by virtue of at least one section that turns inside out. The article has at least one flexible sidewall defining an interior space from an exterior space, where the sidewall is oriented about and spaced apart from a longitudinal axis. A section of the article has a plurality of elongated, longitudinal tucks in the flexible sidewall, the tucks adding to the perimeter of the sidewall sufficiently to permit the section of the article to be turned inside out along the longitudinal axis to collapse the article.

It will be appreciated that the illustrations are not necessarily to scale with respect to their relative proportions. For example, the thicknesses of the articles and the spaces between them have been exaggerated for clarity in some FIGS., as in FIGS. 3 and 4.

DETAILED DESCRIPTION OF THE INVENTION

Figure 1:
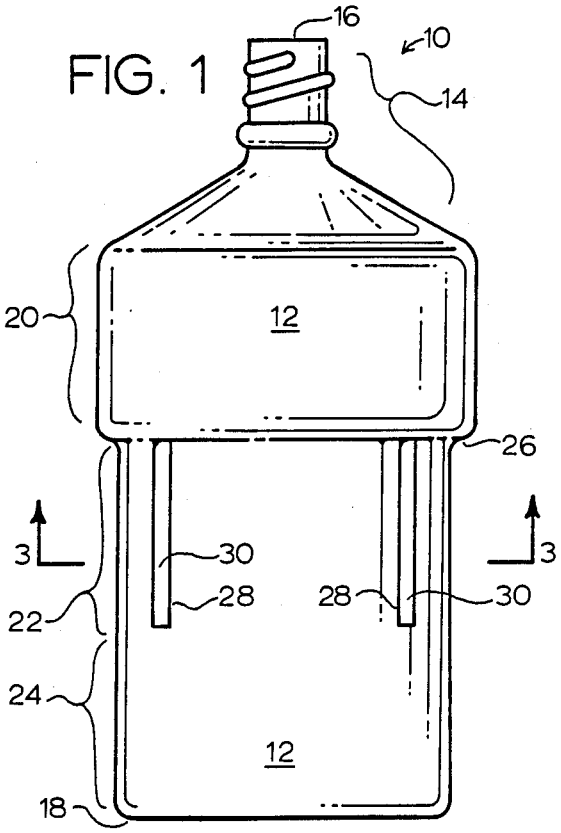
FIG. 1 is an elevation view of one embodiment of the invention shown as it would be formed, in its expanded state.
Figure 3:
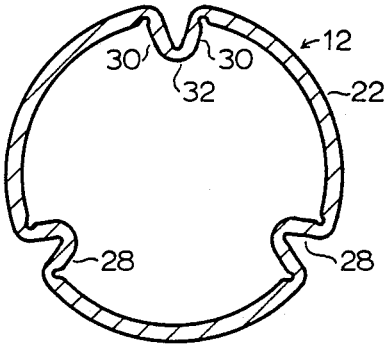
FIG. 3 is a plan, sectional view of the bottle in FIG. 1 in its extended, uncollapsed state at elevation 3—3.
Figure 4:
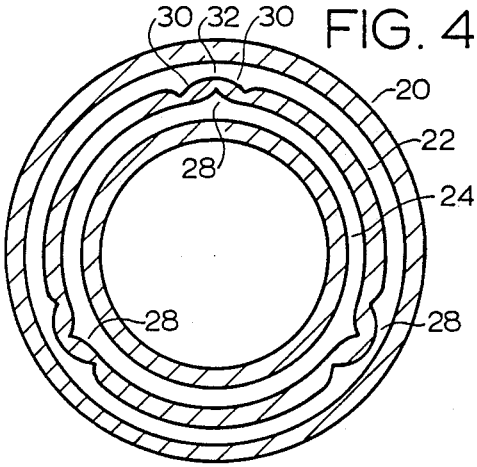
FIG. 4 is a plan, sectional view of the bottle in FIG. 2 in its telescoped, collapsed state at elevation 4—4.

The invention will now be described in more detail with reference to the various Figures. Shown in FIG. 1 is an elevation of the collapsible article 10 of this invention, in this case depicted as a plastic, blow-molded bottle, such as a liquid container. In this embodiment, the article 10 has at least one sidewall 12, as well as a top 14, which contains a spout 16, and a base or bottom 18. Since the article 10 has a circular cross-section, as seen in FIGS. 3 and 4, there is only one sidewall 12. It is apparent that if article 10 had a different cross-section, such as a rectangle, there would be four sidewalls 12. The sidewall 12 defines an interior space, the inside of the bottle 10, from an exterior space, the outside of the bottle, which is essentially the function of a container. Generally, sidewall 12 is spaced apart from and generally parallel to a longitudinal axis.

Sidewall 12 is divided into three sections of roughly equal height, measured, axially along article 10: top section 20, middle section 22 and bottom section 24. The boundary between top section 20 and middle section 22 is marked by a draft, discontinuity or shelf 26 whereby the cross-section and diameter of the middle section 22 is reduced from that of the top section 20.

Conventional blow-molded containers may be formed with parallel sides that have no draft, that is, a taper or narrowing of the sides, such as that seen at 26. If such a container has a circular cross-section as does the cylindrical article 10 in FIG. 1, at the draft 26, turning the article 10 inside-out in a telescoping mode is difficult. In order to invert the article 10, the portion on the inside, the middle section 22 if it possesses no tucks 28, would have to be crumpled into a non-circular shape to fit within the circular shape of the portion of itself that it must pass inside of.

A middle section 22 with tucks 28, such as shown in cross-section in FIG. 3, however, may be inverted in a telescoping manner with relative ease. The cross-section shown in FIG. 3 will form to near circular cross-section shown in FIG. 4 when inverted without changing its perimeter. The inverted cross-section, middle section 22, will fit within the top section 20 and encompass the remaining section, bottom portion 24, without requiring it to crumple.

This improvement is accomplished using the tucks or longitudinal folds 28 in the middle section 22. Creases or tucks in the sidewalls of containers have been used before to enable them to collapse, but heretofore the creases have always been positioned transverse or normal to the longitudinal axis, as in the conventional bellows-type, or in a helical or spiral configuration, never as a vertical or near vertical, that is, approximately parallel to the longitudinal axis of the article. The angle of the tuck should be less than 45° with respect to the longitudinal axis to be considered longitudinal, preferably less than 10°.

The article 10 shown uses this telescoping to collapse in a predictable, reversible, and repeatable way that reduces its capacity by nearly two-thirds. This reduction in capacity may be used to minimize the empty shipping volume or the empty disposal volume of the article 10. For example, the empty bottles will take up less space while being transported to being filled or after use. It may also be used to minimize the storage volume required for a partially empty bottle or used to minimize the air in the container over the partially used contents of the bottle.

Figure 2:
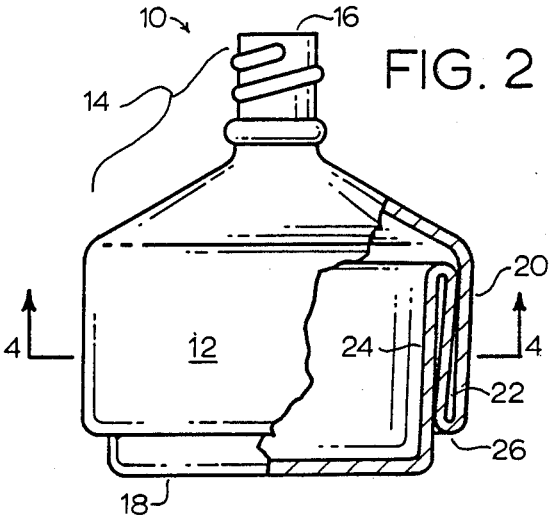
FIG. 2 is a cross-sectional elevation view of the bottle of FIG. 1 in its telescoped state.

In further detail, tucks 28 have a generally V-shaped profile, as seen in FIGS. 3 and 4, and have two walls 30 meeting at an apex 32. The V-shaped tucks 28 may be designed to collapse further than depicted in FIG. 3 so that they will consume negligible volume while the bottle 10 is in its extended shape. When bottle 10 is compressed or telescoped axially, the middle section 22 is turned inside out, aided by the tucks 28 which expand to increase the area encompassed by the section as depicted in the cross-section of FIG. 4 taken at line 4—4 in FIG. 2. This expanded middle section 22 will, by design, fit within the circumference of bottom section 24 as well as outside the effective outside diameter of itself, section 22, before inversion, as shown in FIG. 3. Greater or fewer tucks than three may, of course, be used to advantage. As noted, the use of vertical or near vertical tucks 28, that is, parallel to the longitudinal axis of article 10 provide advantages such as simplicity of design and manufacture. It will also be appreciated that the tucks 28 may, in some embodiments, have more than a single fold. That is, it is anticipated that the tuck 28 may have more than one fold, such as a section of vertical bellows. The tucks 28 must be of sufficient width in a collapsed state to permit the section 22 of the article 10 to be turned inside out in an expanded state of the section 22, though the article 10 itself is in a collapsed or telescoped state. To repeat for the purpose of emphasis on this point which may be confusing, when the tucks 28 are in a collapsed or folded state, as in FIG. 3, the article 10 itself is in an expanded or extended state, as seen in FIG. 1. However, when the article 10 is in a telescoped or collapsed state, seen in FIG. 2, the tucks 28 will themselves be expanded or widened to provide a greater circumference for the middle section 22, as in FIG. 4.

While the bottle 10 may be considered to be "latched" in its extended position (FIGS. 1) in the sense that a larger force is required to start the telescoping action than to continue or reverse it; it is in a stable condition in all positions. No force is required to maintain any position.

If the force required to extend the telescoping is less than the weight of the contents of an open and partially filled and partially collapsed container, then it may be lifted by the spout 16 without extending the container. This property is convenient and achieved by balancing the size of the container, the wall thickness, and properties of the material used to make the container.

Also depicted in FIGS. 3 and 4 are tucks 28 which have the corners narrowed or thinned to permit collapsing with greater ease.

Several variations in design are easily generated that differ from the bottle shown without departing from the spirit and scope of the invention. Rectangular or other cross-sections, jars with draft, containers that collapse to near zero contents, and pour spouts that retract are among those that are useful variations of the invention.

Figure 5:
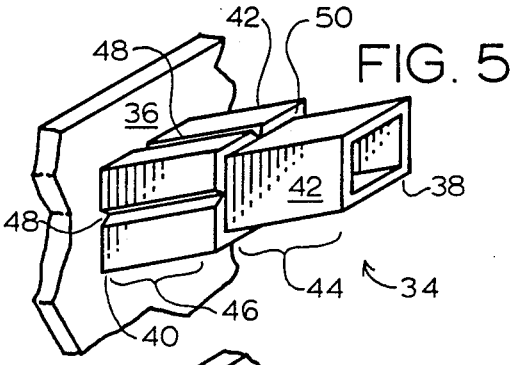
FIG. 5 is an isometric, partial view of an embodiment of the present invention as a pour spout in its expanded state.
Figure 6:
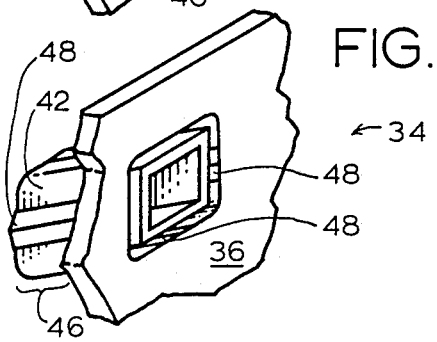
FIG. 6 is an isometric, partial view of the pour spout embodiment of the invention of FIG. 5 in its collapsed, telescoped state.

Shown in FIGS. 5 and 6 is another embodiment of the present invention in a pour spout form 34. Pour spout 34 is depicted, for example, as integral with container wall 36, partially shown, where the spout 34 has a distal end 38 and a proximal end 40. The distal end 38 and the proximal end 40 are connected by multiple sidewalls 42, in this case four, of rectilinear or quadrilateral shape. Sidewalls 42 again define an interior space, the inside of the spout 34, from an exterior space, i.e., the outside of the spout. The sidewalls 42 have a distal section 44, equivalent to the bottom section 24 of the container 10 of FIG. 1, and a proximal section 46, equivalent to the middle section 22 of container 10, as well as a shelf, discontinuity or draft 50. The shelf or draft 50 is optional at this point; note that no such draft is present between the middle section 22 and the bottom section 24 of the FIG. 1 bottle 10. In this embodiment, there is no equivalent to the top section 20 of the FIG. 1 container 10, and the tucks or folds 48 are in the proximal section 46.

The operation of the pour spout 34 is similar to that of bottle 10. Proximal section 46 turns inside out with the aid of the expanding V-fold tucks 48, drawing distal section 44 into it, as well as inside container wall 36. Thus, spout 34 collapses or telescopes neatly out of the way during the shipping, storage or stacking of the container, but be readily and repeatedly deployed when it is desired to dispense some of the container contents. It will be appreciated that in the actual design of a pour spout 34 as shown in FIGS. 5 and 6 that fillets in the corners may be required to assist in the telescoping, and that it would be within the skill of an artisan to provide such fillets.

The pour spout 34 embodiment is important because it demonstrates the versatility of the collapsible article of the invention. It illustrates that the article need not have a top and bottom surface, nor that it be in container form to be useful. Second, it is demonstrated that the cross-section of the collapsible article need not be circular, but may be of another cross-section, including, but not limited to rectilinear, triangular, ellipsoid, or other shapes. Thirdly, the sections of the collapsible article need not be three, but may be two, or even more. It is within the anticipated scope of the invention to provide multiple sections having drafts 26 or 50 between them. Thus, a relatively lengthy article could be collapsed into a relatively small volume. It is preferred that the sections be in pairs, with one of the sections in the pair having tucks.

Figure 7:
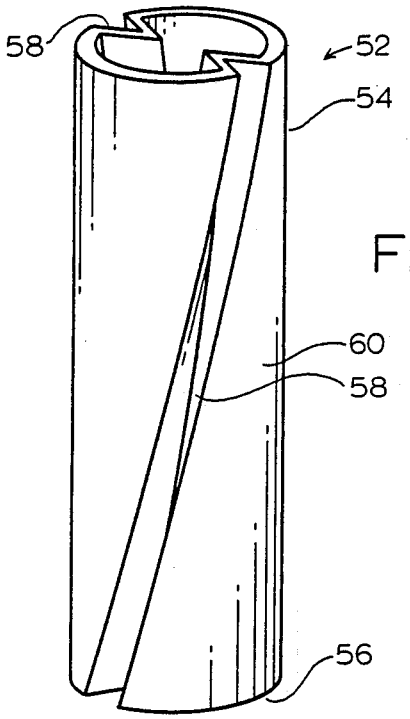
FIG. 7 is a three-quarters view of a tube having generally longitudinal tucks along its entire length.

Shown in FIG. 7 is another version of the present invention depicted as an elongated tube 52 having a sidewall 60 with an open top end 54 and open bottom end 56, where the entire length of the tube is spanned by longitudinal tucks 58. It is noted that in FIG. 7 the tucks 58 are depicted as only generally vertical, being a few degrees from the true vertical of the tube 52. While this slight twist may aid in the collapsing of tube 52, it does not present the severe helical groove of prior collapsing articles inasmuch as the collapsing action is primarily obtained from the vertical nature of tucks 58. As noted earlier, such tucks should be at an angle from the vertical considerably less than 45°, preferably within ±10°of the longitudinal axis.

Figure 8:
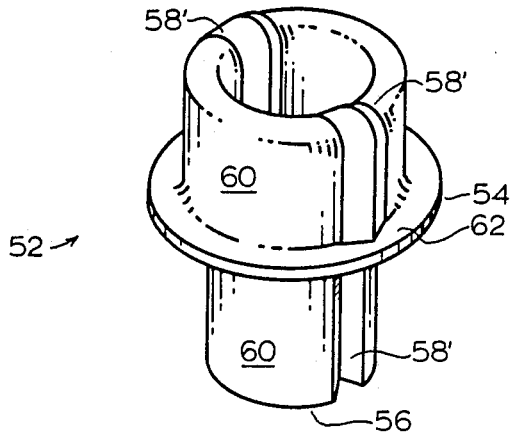
FIG. 8 is a three-quarters view of the tube of FIG. 7 in a partially collapsed state.

Finally, shown in FIG. 8 is a version of the tube 52 where the tuck 58' is vertical and tube 52 is in a partially collapsed state to illustrate how the tuck 58' widens upon inversion of the tube 52. The FIG. 8 version has a top rim 62 to aid in inverting the tubular article 52.

Many modifications would be apparent to one skilled in the art besides those discussed above. The scope of the invention is defined only by the appended claims.

I claim:

1. A collapsible article comprising:

at least one flexible sidewall defining an interior space from an exterior space about a longitudinal axis, where the flexible sidewall is parallel to the longitudinal axis;

a first section of the artical having a plurality of elongated, longitudinal tucks in the flexible sidewall, the tucks adding to the perimeter of the sidewall to expand the perimeter sufficiently to permit the section of the article to be turned inside out over itself along the longitudinal axis to collapse the article, where the tucks are peripherally spaced apart from one another and where the peripheral distance between the tucks is greater than the width of the tucks, when expanded; and a second section in the flexible sidewall adjacent the first section, where the second section has no tucks and is at least partially encompassed by the first section when the article is collapsed.

2. The collapsible article of claim 1 wherein a draft is present between the first section and the second section, and the first section and the second section have different circumferences.

3. The collapsible article of claim 1 further comprising a third section not having tucks also adjacent the first section such that the first section having tucks has the second section and the third section, both without tucks, on either end of the first section, and wherein the tucks add to the perimeter of the first section sufficiently to permit it to be turned inside out to encompass at least partially the second section and be contained at least partially by the third section to collapse the article.

4. The collapsible article of claim 3 wherein the article may be collapsed by pushing inward toward the first section on either the second section or the third section.

5. An improved collapsible container comprising:

a first end and a second end, and a sidewall integral therewith joining the first end and the second end, the sidewall defining an interior space from an exterior space about a longitudinal axis, where the flexible sidewall is parallel to the longitudinal axis;

the improvement comprising a first section of the sidewall having a plurality of longitudinal tucks, wherein the tucks unfold and add to the perimeter of the sidewall to expand the perimeter sufficiently to permit the section of the sidewall to be turned inside out over itself along the longitudinal axis to collapse the container, where the tucks are peripheraly spaced apart from one another and where the peripheral distance between the tucks is greater than the width of the tucks, when expanded; and a second section in the flexible sidewall adjacent the first section, where the second section has no tucks and is at least partially encompassed by the first section when the article is collapsed.

6. The collapsible container of claim 5 wherein the tucks have a collapsed state and an explanded state, wherein when the tucks are in a collapsed state they are protruding inward.

7. The collapsible container of claim 5 wherein a draft is present between the first section and the second section, and the first section and the second section have different circumferences when the container is in an expanded state.

8. The collapsible container of claim 6 further comprising a third section not having tucks also adjacent the first section such that the first section having tucks has the second section and the third section, both without tucks, on either end of the first section, and wherein the tucks add to the perimeter of the first section sufficiently to permit it to be turned inside out to cover at least partially the second section and be contained at least partially by the third section to collapse the container.

9. The collapsible container of claim 8 wherein the container may be collapsed by pushing inward the first section on either the second section or the third section.

10. An improved collapsible container comprising:

a first end, a second end, a sidewall integral therewith joining the first end and the second end, the sidewall defining an interior space from an exteroir space about a longitudinal axis, where the flexible sidewall is parallel to the longitudinal axis;

a first section in the sidewall, and a second section in the sidewall, the improvement comprising a plurality of longitudinal tucks approximately parallel to the axis of the sidewall in the first section, wherein the tucks may unfold and add to the perimeter of the first section to expand the perimeter sufficiently to permit the first section of the container to be turned inside out along the longitudinal axis and over the second section to collapse the container, where the tucks are peripherally spaced apart from one another and where the peripheral distance between the tucks is greater than the width of the tucks, when expanded; and a third section not having tucks also adjacent the first section such that the first section having tucks has the second section and the third section on either end of the first section, and wherein the tucks add to the perimeter of the first section sufficiently to permit it to be turned inside out to cover at least partially the second section and be contained at least partially by the third section to collapse the container.

11. The collapsible container of claim 10, wherein the container has an expanded state and a collapsed state, the collapsed state characterized by the first section being turned out to encompass and at least partially contain the second section, where the first section has a first perimeter and the second section has a second perimeter and the first perimeter is larger than the second perimeter when the container is in its expanded state, and the container further comprises a draft sidewall portion that provides transition between the first and second peripheries.

12. The collapsible container of claim 10 wherein the tucks have a collapsed state and an expanded state, wherein when the tucks are in a collapsed state, the container is in an expanded state, they are protruding inward.

13. The collapsible container of claim 10 wherein the container may be collapsed by pushing inward toward the first section on either the second section or the third section.

* * * * *